US005692789A

United States Patent [19]

Woodsum

[11] Patent Number: 5,692,789

[45] Date of Patent: Dec. 2, 1997

[54] RATCHET SNATCHIT GRAPPLING HOOK TOOL AND METHOD OF USE

[76] Inventor: David A. Woodsum, 2623 Gladiolus St., New Orleans, La. 70122

[21] Appl. No.: 629,139

[22] Filed: Apr. 8, 1996

[51] Int. Cl.[6] ..... B25B 33/00

[52] U.S. Cl. ..... 294/19.1; 294/1.1; 81/3.43

[58] Field of Search ..... 294/1.1, 15, 19.1, 294/26, 31.2, 58; 81/3.4, 3.43, 64, 65, 487, 488; 16/114 R; 119/799, 803, 804

[56] References Cited

U.S. PATENT DOCUMENTS

| | | | |
|---|---|---|---|
| 1,614,610 | 1/1927 | Grant | 81/3.43 |
| 2,522,454 | 9/1950 | Lewry | 294/19.1 |
| 5,509,705 | 4/1996 | Woodsum | 294/1.1 |

*Primary Examiner*—Dean Kramer

[57] ABSTRACT

A tool for grasping a ratchet socket or other objects such as pipes and rods. The object can be stopped from turning due to the friction of the tool or the object can be rotated when desired. The tool comprises a flexible friction belt connected at one end to an open jaw which may be closed and connected at its other end to a spring biased rod or movable handle. In one embodiment a slidable trigger is connected to the spring biased rod to permit a loop in the flexible belt to be enlarged for slipping around a socket or other object. When the trigger is released the loop grips the socket and frictionally holds the socket while closing the jaw. In a second embodiment the flexible friction belt connects to a handle which is slidably held in an outer housing. The handle may be moved to open and close a loop in the friction belt. An automatic lock is provided in the housing so the friction belt will turn the object being held as the belt loop is enlarged and made smaller. Both embodiments provide a lever connected to the jaw so the jaw may be pulled toward the housing to close the belt loop opening.

2 Claims, 6 Drawing Sheets

36
40
34
42
45
32
44
30
72
46
50

RATCHET SNATCHIT GRAPPLING HOOK TOOL AND METHOD OF USE

BACKGROUND OF THE INVENTION

The present invention relates to tools for holding ratchet sockets to prevent the sockets from turning during reverse strokes of the ratchet.

A common and frustrating problem encountered by mechanics involves the installation or removal of a nut or bolt with a ratchet where the ratchet and socket are in a location which cannot be reached by hand to stop reverse turning of the socket. When a nut or bolt is very loose a ratchet, being used with a socket to remove or tighten the nut or bolt, will have sufficient friction on the reverse stroke to keep the ratchet from working. To have the socket turn in only the intended direction the socket must be held with sufficient force to allow the ratchet to function. A ratchet socket holding tool with a closed loop friction belt is disclosed and claimed in applicant's U.S. application Ser. No. 08/344,869, filed Nov. 25, 1994 now U.S. Pat. No. 5,509,705.

The present invention further relates to tools for grabbing, holding and turning an object such as a tube, pipe, rod or the like. The use of a resilient spring steel band with a friction coating material such as rubber positioned between a handle and a movable jaw is disclosed in a prior art wrench, U.S. Pat. No. 2,780,951 issued to Bram, Feb. 12, 1957. This prior art wrench uses a loop in the resilient band to fit around a pipe or tube whereby a clamping action will be present, due to the movable jaw, when the handle is turned. The prior art wrench can turn the pipe or tube or clamp onto it only when a rotational force is being applied to the handle.

Another prior art patent, U.S. Pat. No. 3,308,691 issued to Guier, Mar. 14, 1967 discloses the use of jaws to clamp onto a pipe and to turn the pipe with a complex motorized chain extending around the jaws of the apparatus and looping around the pipe.

The problem with the closed loop type holding tool disclosed in U.S. Pat. No. 5,509,705 is the necessity of sliding the closed loop over the top or end of a socket or object being held. To hold a pipe or rod the closed loop type holder disclosed in the prior application is of no value unless an end of the pipe or rod is free so the closed loop may be positioned over the free end.

The wrench disclosed by U.S. Pat. No. 2,780,951 is unable to positively hold or turn an object without turning the handle in only one direction. The wrench is not designed to merely hold and turn an object without the handle being rotated.

SUMMARY OF THE INVENTION

The grappling hook tool of the present invention comprises a housing with a hook means extension attached to one end of the housing. A jaw is pivotally connected to the hook means and a spring means connected to said jaw to bias the jaw in its open position. The housing contains a longitudinally movable belt connecting means. A flexible friction belt is connected at one end to the movable belt connecting means and at the other end to the jaw. The flexible friction belt may be linearly-resilient to provide an inherent tendency for the belt to straighten itself. As the jaw is pivotally moved from an open position to the closed position resting against or near the side of the housing the flexible friction belt is moved from an open loop to a substantially closed loop. An object to be held in the belt loop is captured by placing the open jaw and open belt loop on the object such as a pipe, rod or the like. The jaw is pivotally closed by either moving the belt connecting means within the housing to shorten the belt extending outside of the housing or by pulling a lever attached to the outside of the housing which is attached to the end of the jaw with a string or cord. After the jaw and belt loop are closed and the object captured the belt connecting means is moved within the housing to pull the flexible belt loop tightly around the captured object. In this position the captured object may be manipulated in any desired manner.

The grappling hook tool in the preferred embodiment has an automated rotating means to support the captured object. The automated rotating means comprises an automatic holding assembly provided with a lock means to hold the captured object in a down position while the belt is being extended into an enlarged loop. A release means in conjunction with the lock means functions to release the lock after the belt loop has been enlarged permitting the object being held to move outwardly in the belt loop. As the belt loop is then contracted by moving the belt connecting means within the housing, the object being held within the loop will rotate due to the friction applied to the object by the friction belt. By repeating the expansion and contraction of the belt loop the object being held may be rotated to any desired position.

To release the captured object it is only necessary to move the belt connecting means within the housing to lengthen the belt located outside of the housing and push the lever to release the tension applied to the jaw through the string. The spring biased jaw will pull open the belt loop and the captured object will be free to move out of the grapple type hook.

The spring means used to bias the jaw toward its open position may be a tension coil spring connected between one end of the jaw pivotally connected to the hook means extension. Other spring means such as constructing the friction belt from a spring steel coated with a rubber friction layer or a linearly-resilient composition may be used. The spring steel belt or linearly-resilient composition would provide a memory that would bias the belt toward its longitudinally extended position which would tend to push the jaw toward its open position as the belt connecting means within the housing is moved to enlarge the belt loop.

Accordingly, a primary object of this invention is to provide a novel friction tool which is compact, easy to construct and may be operated with one hand.

A further object of the invention is to provide a tool for frictionally holding a ratchet socket from turning during its reverse stroke.

Another object is to provide a grasping tool for grasping objects in difficult to reach places or where for safety purposes it is necessary to keep hands clear of object being manipulated.

Yet another object of the invention is to provide a grappling tool which may be manipulated to hold while turning a tube, rod, pipe or other like object.

BRIEF DESCRIPTION OF THE DRAWINGS

In the drawings, where like reference numerals are used to indicate identical components in the various Figures.

DESCRIPTION OF THE PREFERRED EMBODIMENT

Figure 1:
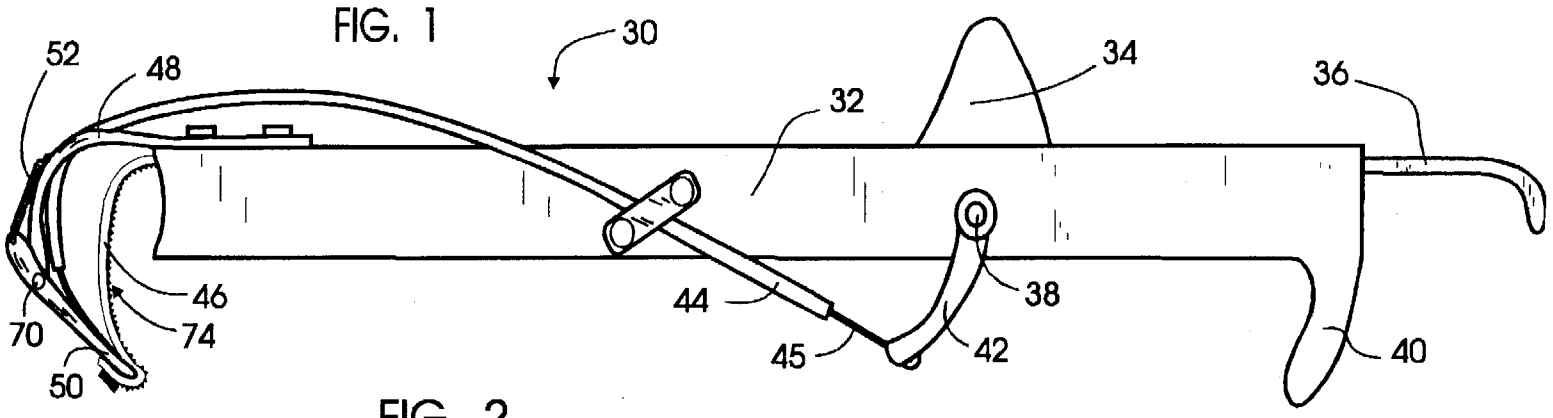
FIG. 1 is a side plan view of a grappling hook tool.
Figure 2:
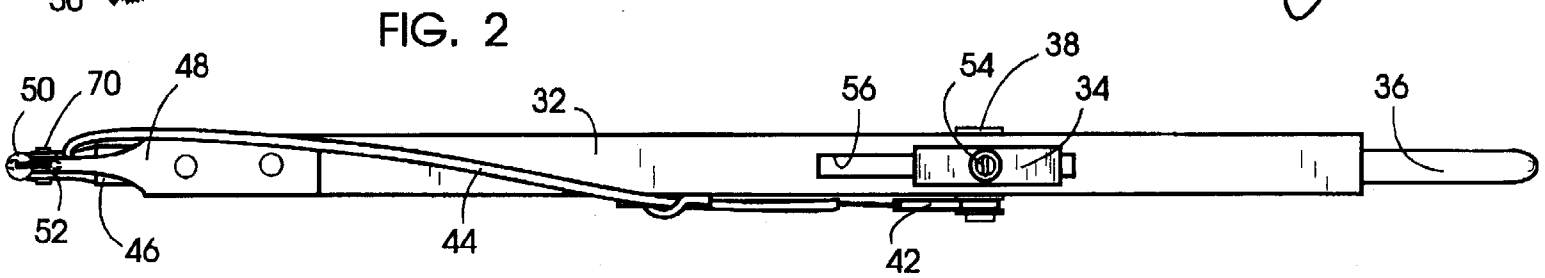
FIG. 2 is a longitudinal top plan view of the tool of FIG. 1.
Figure 3:
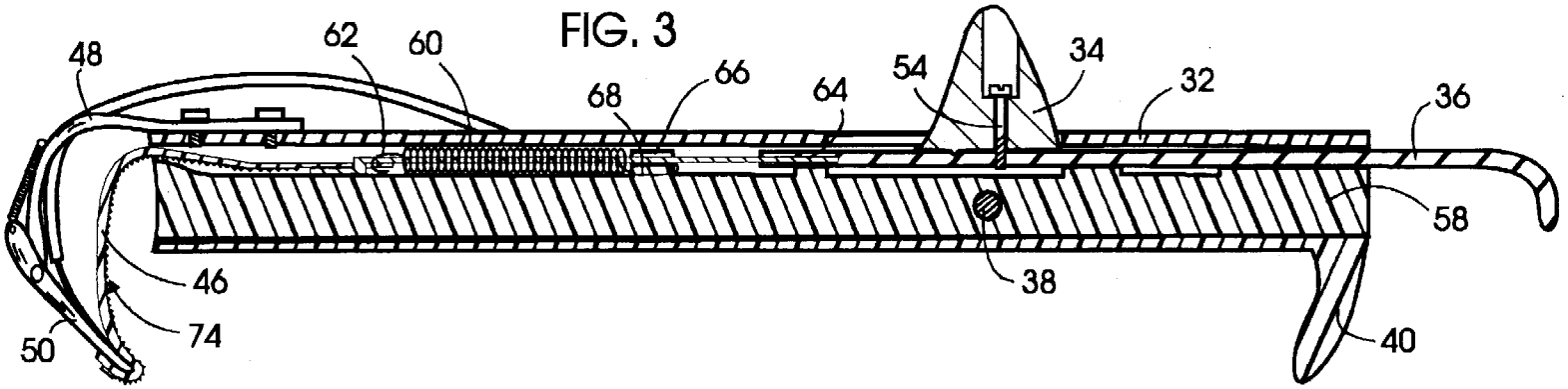
FIG. 3 is a longitudinal partial cross-sectional view of FIG. 1.
Figures 4, 5, 6:
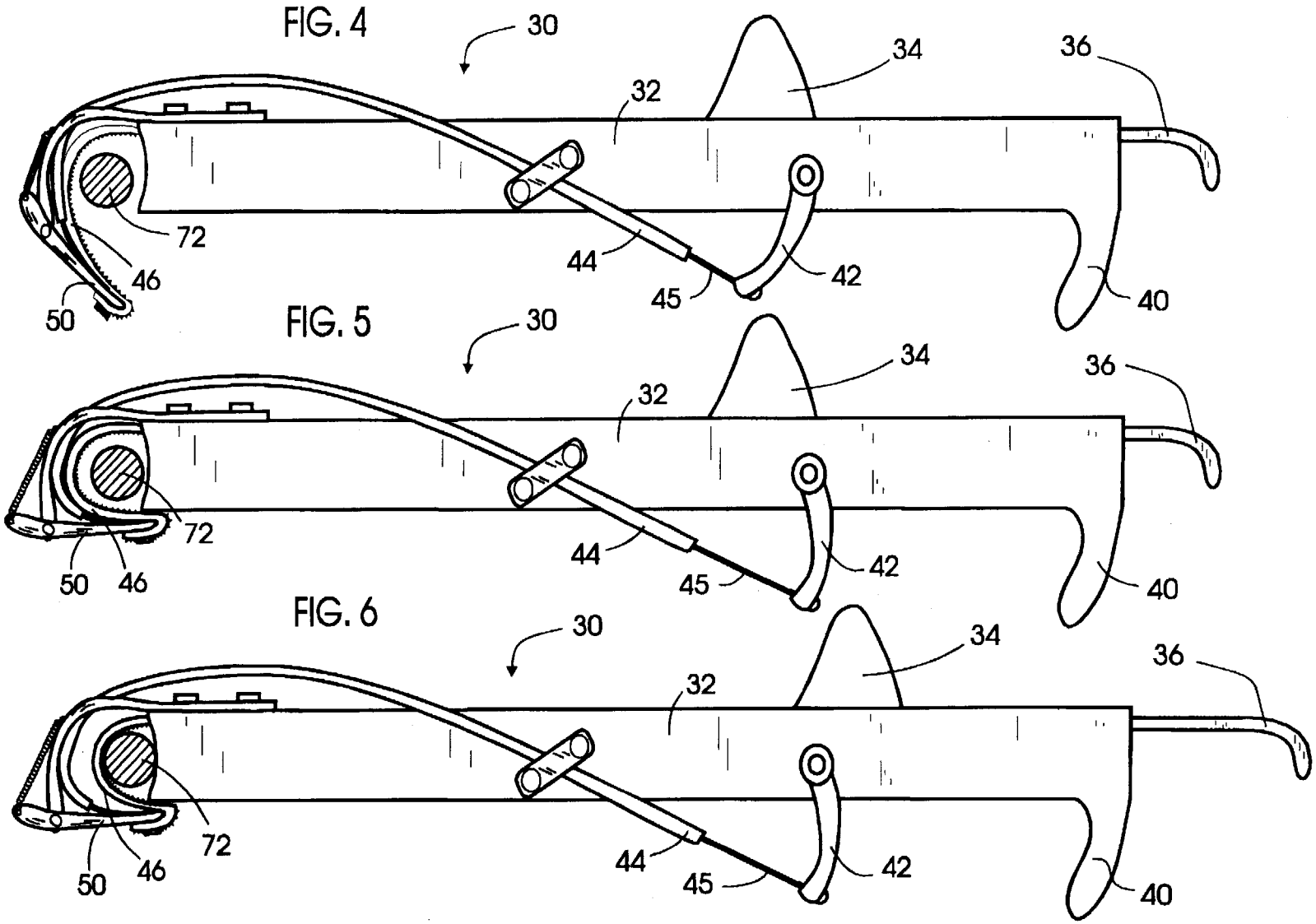
FIGS. 4–6 are side plan views of a grappling hook tool illustrating the operation of the device.

With reference to one embodiment of the present invention illustrated in FIGS. 1–6, the grappling hook tool 30 comprises housing 32 in the form of a handle with adjustable flexible friction belt 46. The handle comprises a central core 58 held within housing 32 by lever bolt 38. The handle finger 40 permits an operator to firmly grasp the handle when the device is being used. Belt 46 extends from the end of housing 32 in the form of an open loop. One end of the friction belt is connected to movable jaw 50 pivotally connected to hook 48, projecting from the end of housing 32, by pivot pin 70. The other end of friction belt 46 is connected to push rod 64 and spring loop 62 located inside housing 32. Push rod 64 is connected to slider 36 slidably held between core 58 and housing 32. Thumb-activated trigger 34 is connected to slider 36 by trigger bolt 54. As the slidable trigger 34 extending through trigger slot 56 of housing 32 is slid along the housing 32 push rod 64 moves one end of friction belt 46 thereby increasing the length of belt forming the loop which extends from the end of the handle housing toward hook 48. As push rod 64 is moved, tension spring 60 is extended. When trigger 34 is released, tension spring 60 draws friction belt 46 into handle housing 32 shortening the length of belt extending outside housing 32. The shortened belt length pulls the end of belt 46 connected to jaw 50, thereby closing the belt loop tight around a socket, or rod 72 as shown in FIG. 6, over which the belt loop has been positioned. Tension spring 60 is anchored within housing 32 by spring loop 68 positioned over projection 66 on core 58.

Jaw 50 with the end of the friction belt connected thereto may be closed, as shown in FIG. 5, prior to shortening of friction belt 46. After rod 72 is positioned in the extended belt loop as shown in FIG. 4, lever 42 is pulled. Lever 42 attached to housing 32 by lever bolt 38 is connected to the end of jaw 50 by a string 45 passing along the handle through a tubing 44. Pulling lever 42 to close jaw 50 will positively capture the rod 72 within a closed loop of the friction belt as shown in FIG. 5.

To use grappling hook tool 30 an operator first pushes trigger 34 to extend tension spring 60 and enlarge the open loop of the friction belt 46. Jaw 50 is biased in the open position with a spring 52 shown in FIG. 1. The object or rod 72 to be held is positioned in open jaw 50, as shown in FIG. 4, with friction belt 46 looped around the object. Jaw 50 is then closed by either pulling on lever 42 attached to the jaw through string 45 or by releasing trigger 34 permitting the spring tension of spring 60 to draw the loop against the object. Spring 60 maintains tension on the belt to provide a frictional resistance against turning of the object being held. The object held in the loop is pulled against the end of handle housing 32 which may be formed with a concave surface to aid in holding the object in the desired position. Additional friction may be provided by pulling trigger 34 to increase the tension of the belt upon the object being held. Friction belt 46 may be provided with a friction enhancing coating 74 to increase the gripping ability of the belt.

If the object being held is a ratchet socket fitted onto a nut or bolt, when the ratchet socket handle is turned in the desired direction the socket will slide within the friction belt loop and the nut or bolt will be turned. On the reverse stroke of the ratchet handle, the frictional contact of the belt loop around the circumference of the socket will hold the socket from turning and permit the ratchet to operate. Where more frictional resistance is needed to keep the socket from turning than is provided by the tension spring, the ratchet socket can be gripped even more firmly by pressing back against the trigger with the operators thumb. This will pull the friction belt tightly around the socket creating as much friction as necessary to keep the socket from turning backwards. After the nut or bolt has been turned to the desired degree the socket is removed and the trigger pressed to enlarge the belt loop and permit the spring biased jaw to open.

Figure 10:
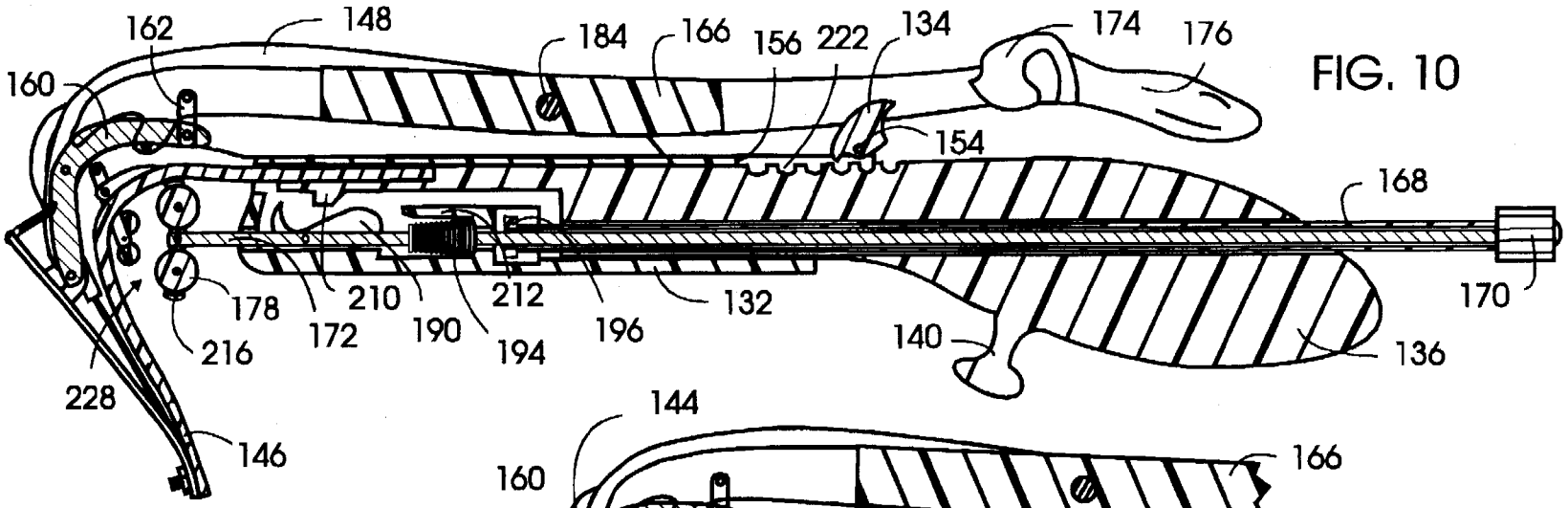
FIG. 10 is a longitudinal partial cross-sectional view of FIG. 7.

Another preferred embodiment of grappling hook tool 130 of the invention as illustrated in FIGS. 7–18 comprises a housing 132 provided with a hook 148 extending from one end of housing 132. Hook enhancer 160 is pivotally connected by pivot pin 198 to hook 148. Jaw 150, spring biased in its open position by spring 152, is pivotally connected by pivot pin 155 to hook enhancer 160. Handle 136 is slidably positioned within housing 132. Flexible friction belt 146 is connected between the end of jaw 150 and to the end of handle 136 located within housing 132. Lever 142 is pivotally connected to the side of housing 132 and is connected to the end of jaw 150 by a string 145 passing through tubing 144. Leverage trigger 134 is pivotally connected to housing 132 with pivot pin 154 and meshes with trigger notches 222, see FIG. 10, located in handle 136. Leverage trigger 134 is biased in its disengaged positioned, as shown in FIG. 10, by a spring or other means (not shown).

In operation leverage trigger 134 and housing 132 are moveable with relation to handle 136. As handle 136 is slid outwardly in relation to housing 132, friction belt 146 attached to its end is pulled inwardly through the open end of housing 136. This action shortens the length of friction belt 146 which extend from the housing and is connected to the end of jaw 150. As friction belt 146 is shortened the open loop is pulled against an object, such as pipe 224 shown in FIG. 11, and the end of the open jaw 150 is pulled down near the side of housing 132. To enhance the frictional contact of friction belt 146 against pipe 224 one may press leverage trigger 134 with the operators thumb so as to pivot the leverage trigger into engagement, through trigger slot 156, with trigger notches 222 located in the handle 136. As the leverage trigger is pushed the notched handle will be slid outwardly and the belt loop will be tightened in enhanced frictional contact with the object being held within the belt loop.

Figure 16:
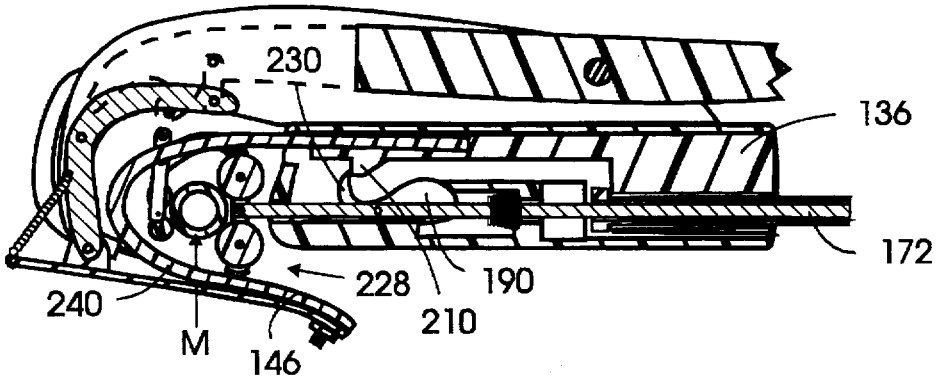

Another method of closing jaw 150, to capture pipe 224 or other object to be held within the friction belt loop, would be to pull on the lever 142 which is attached to the end of jaw 150 by string 145. Lever 142 is connected to housing 132 by a lever bolt 138 and has friction indents 139 to positively hold the lever in a desired position. This action will pull and hold the jaw closed, as illustrated in FIG. 16, before the belt is shortened by the movement of handle 136.

The preferred embodiment is provided with automated holding assembly 228 to support the object being held. Automated holding assembly, 228 as shown in FIG. 16, allows the object to be held in a down position near the end of housing 132 and to move outwardly only after belt loop 240 is extended by the movement of handle 136 in relation to housing 132 shown in FIG. 17. After the object is moved outwardly by automatic holding assembly 228 friction belt loop 240 can then be pulled by moving the handle 136. As friction belt loop 240 is being pulled toward housing 132, the object being held will rotate. In this manner the object being held can be rotated to any desired position by repeating the belt loop enlargement and contraction action.

Figure 17:
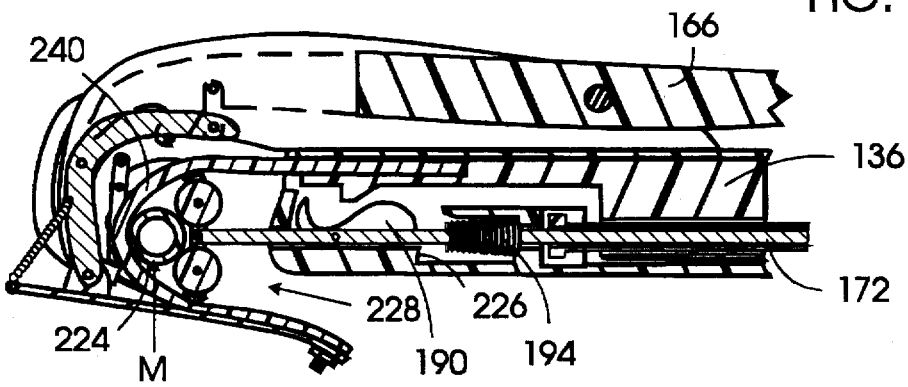

Automatic holding assembly 228 comprises a set of support rollers 178 which are movably connected to roller support shaft 172 by means of roller support bracket 216 pivotally connected to head 232. Roller support shaft 172 extends through longitudinal openings located in housing 132 and handle 136. Roller support shaft 172 is spring biased in its extended position, as shown in FIG. 10. Belt loop 240 when contracted against the object being held will push against support rollers 178 thereby pushing roller support shaft 172 down compressing compression spring 194. Lock hook 190 is pivotally connected by lock hook pivot pin 234 to the roller support shaft 172 within housing 132. Housing 132 is provided with locking ledge 226 and locking cam 212. When roller support shaft 172 is in the down position lock hook 190 will be pressed into locking engagement with locking ledge 226 by bumping against locking cam 212. Lock hook 190 has a lock hook tail 230. Complementary positioned to lock hook tail 230 within housing 136 is a trip ledge 210 formed as part of movable handle 136. As handle 136 is moved to expand friction belt loop 240, lock hook tail 230 will contact trip ledge 210. Lock hook 190 will be disengaged from locking ledge 226 and the spring tension on roller support shaft 172 will move the object being held to its extended position, as shown in FIG. 17.

Figure 11:
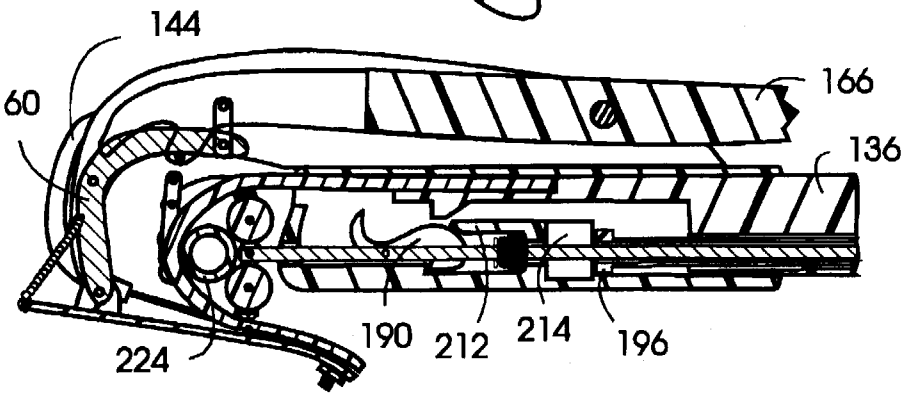
FIG. 11 is a partial side cross-sectional view illustrating a captured object.
Figure 14:
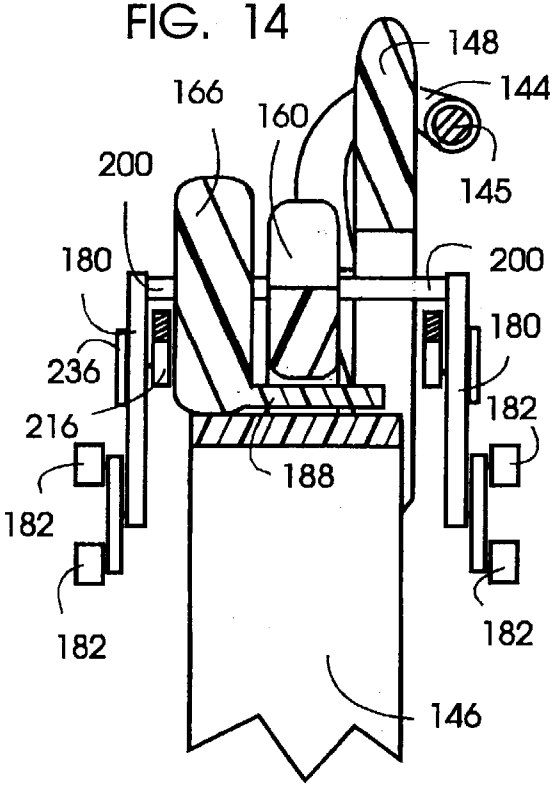
FIG. 14 is an enlarged partial cross-sectional view taken along line 14—14 of FIG. 12.
Figure 12:
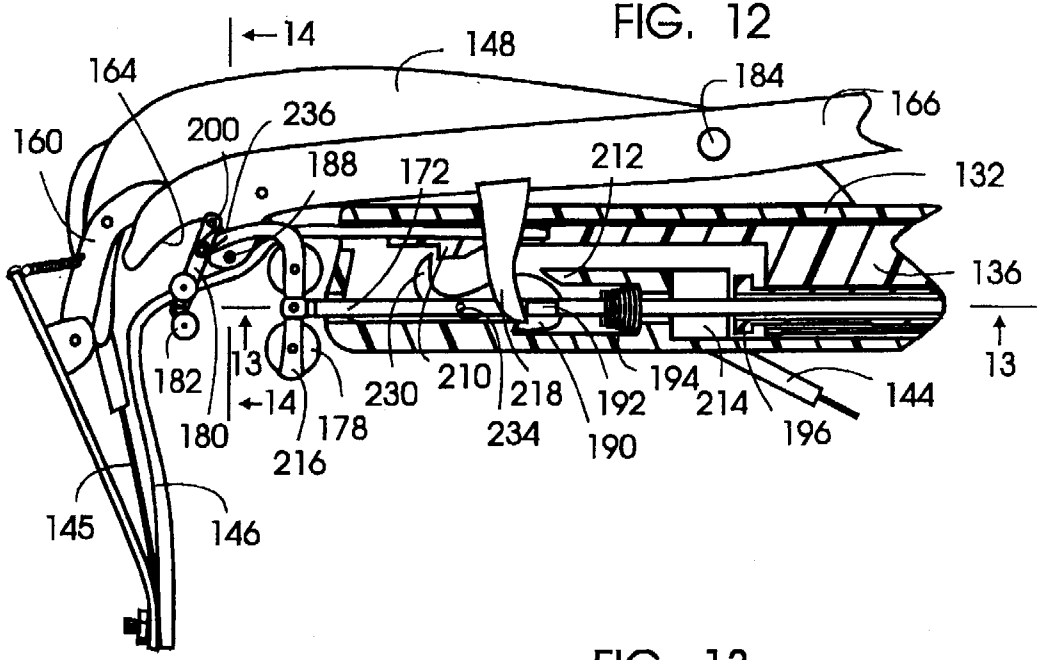
FIG. 12 is an enlarged partial side cross-sectional view of FIG. 8.
Figure 13:
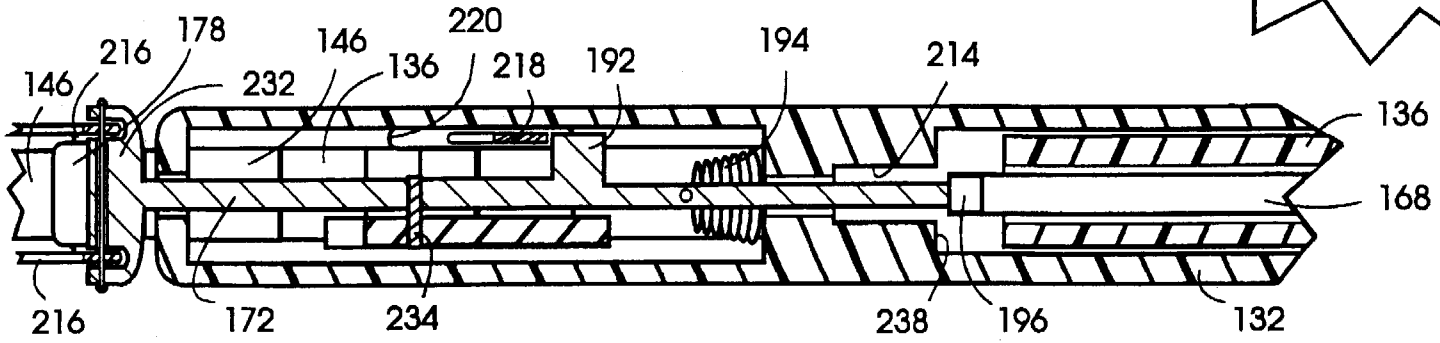
FIG. 13 is an enlarged cross-sectional view taken along line 13—13 of FIG. 12.

To provide a positive hold on an object, such as pipe 224 illustrated in FIG. 11, positioned against support rollers 178, the support assembly comprises two pair of lock brace rollers 182, shown in FIGS. 12 and 14. Lock brace rollers 182 are connected to support roller bracket 216 with a pair of lock braces 180. Lock braces 180 are biased with a spring means, such as spring clip 236 see FIG. 12, toward support rollers 178 so support rollers 178 and lock brace rollers 182 tend to clamp an object being held. The rollers holding the object permits the object to be rotated. Connected between the ends of the pair of lock braces 180 is a control pin 200. Control pin 200, as later described, permits lock brace rollers 182 to be moved away from the support rollers 178 to permit capture of an object such as pipe 224 illustrated in FIG. 8.

The holding assembly further comprises a lock pipe 168, see FIG. 10, provided with a thumb nut 170 is rotabably connected over the end of roller support shaft 172 and extends outwardly from handle 136. Lock pipe 168 extends through handle 136 and projects into housing 132. A pair of lock pipe ears 196 are provided on the end of lock pipe 168 located within housing 132. Lock pipe 168 moves outwardly of handle 136 when roller support shaft 172 is pulled down. When lock pipe 168 moves with roller support shaft 172 the lock pipe ears 196 move between a pair of ear support ledges 214. When roller support shaft 172 is in its down position lock pipe ears 196 will clear ear support ledges 214 and permit thumb nut 170 to be turned so lock pipe ears 196 will be positioned over ear stop ledges 238 illustrated in FIG. 13. In this manner the holding assembly may be manually locked in its down position. With the holding assembly locked in its down position one may utilize the tool without rotating the object being held.

Figure 7:
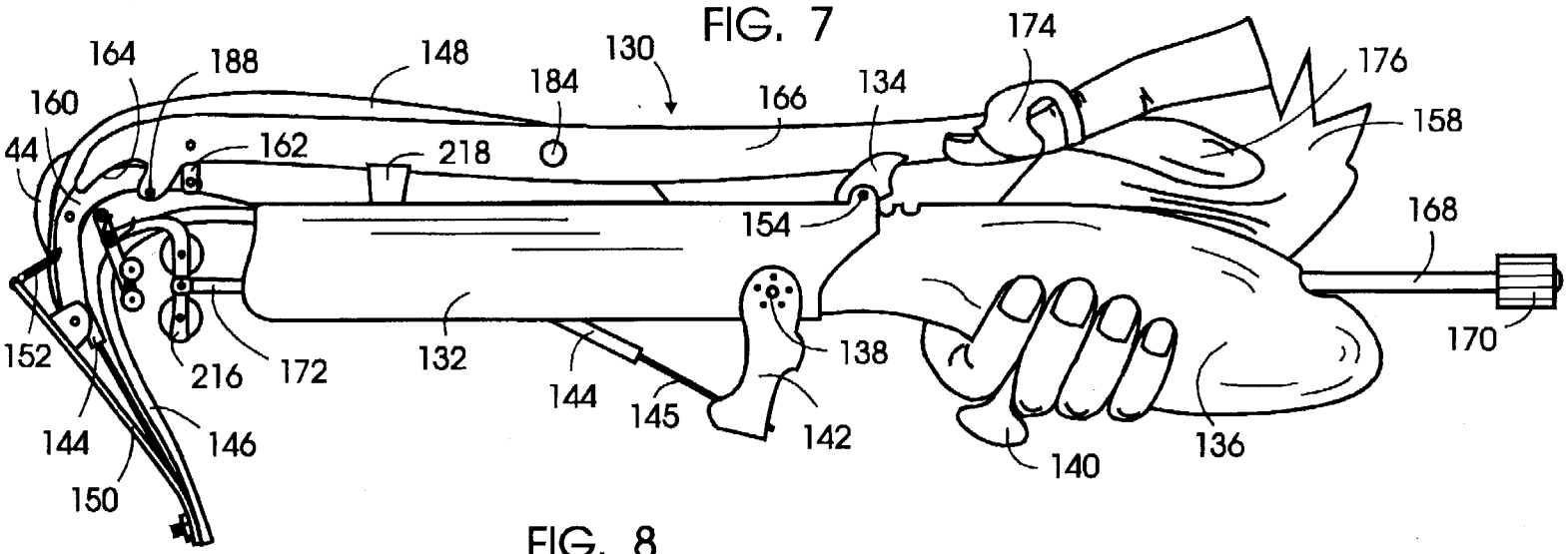
FIG. 7 is a side plan view of another embodiment of a grappling hook tool.

The preferred embodiment is provided with a control arm 166 pivotally connected to hook 148 with pivot shaft pin 184. A palm plate 176 and thumb grip 174 on one end of control arm 166 allows an operator to easily hold handle 136 and move housing 132 by either pushing leverage trigger 134 with the thumb or by pushing housing 132 forward in relation to handle 136 by moving control arm 166 forward. An operators hand 158 is shown in FIG. 7 to illustrate holding grappling hook tool 130. A knob 140 extends from handle 136 to aid in a firm grip of handle 136. The other end of control arm 166 is connected to one end of hook extender 160 through a link 162 and has a control arm cam surface 164. Control arm 166 further comprises a control arm projection 218 extending through a control arm projection slot 220 in housing 132 and is positioned next to a shaft projection 192 connected to roller support shaft 172. Another feature of control arm 166 is a pressure pin 188 extending from the lower edge of control arm 166 across the width of friction belt 146.

Figure 8:
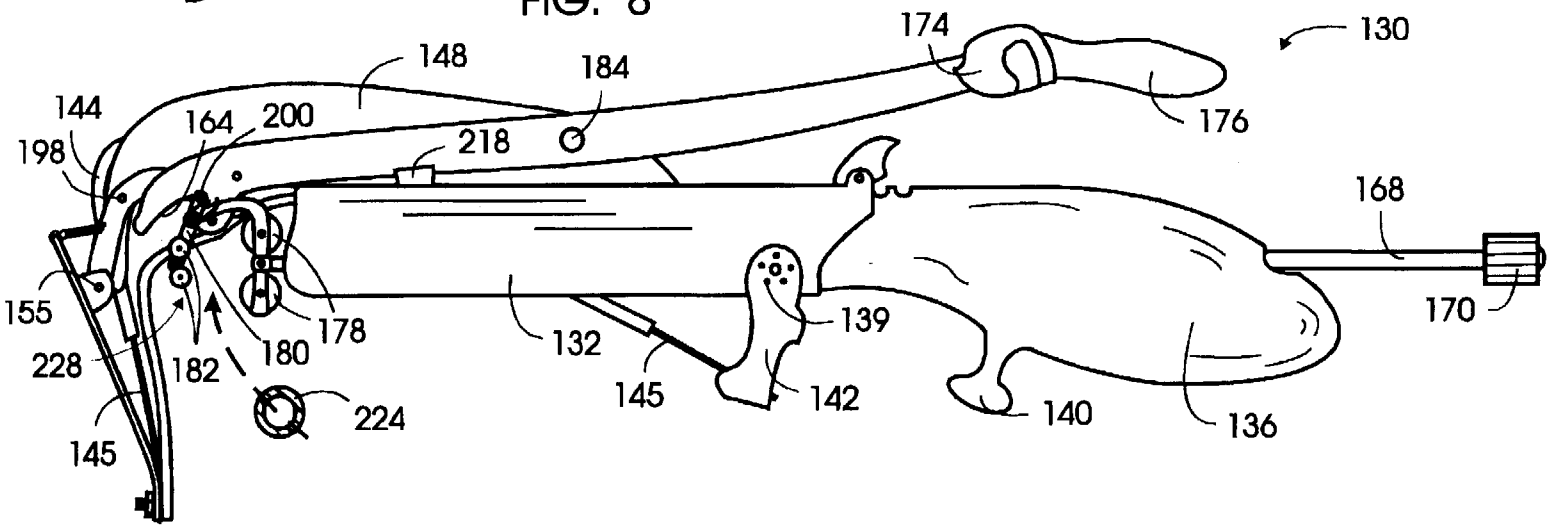
FIG. 8 is a side plan view of the tool of FIG. 7 illustrating the operation of the tool in preparation to capture an object.
Figure 9:
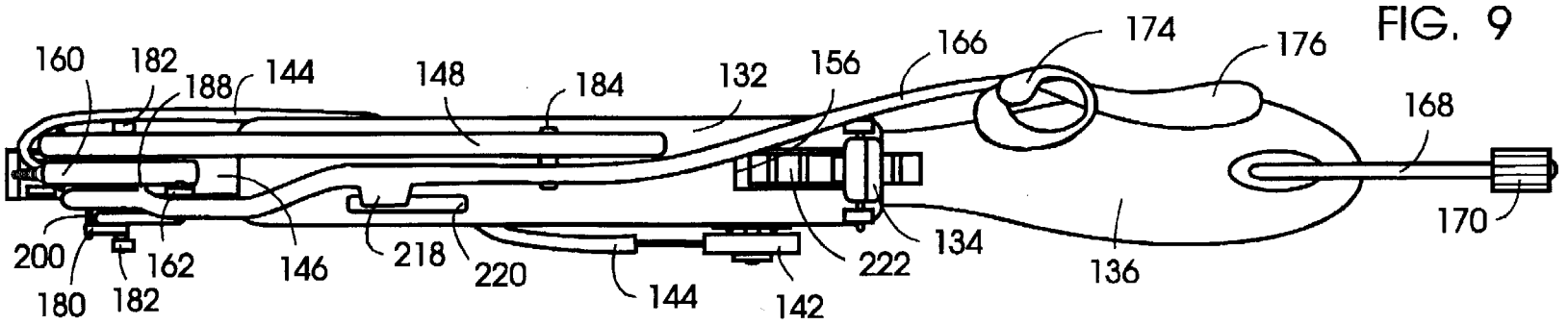
FIG. 9 is a top plan view the tool of FIG. 7.

In operation the control arm 166 is pivoted away from handle 136, as shown if FIG. 8, which lowers control arm cam surface 164 against control pin 200 located on the end of lock braces 180. As the control arm is raised further, control arm projection 218 will push down on the shaft projection 192, as shown in FIG. 12, pulling the roller support shaft down to its lowest position and thereby engaging the lock hook with the locking ledge. In this position control arm 166 has pushed control pin 200 along control arm cam 164 so the opening between the support rollers and the lock brace rollers is at a maximum for insertion of an object such as pipe 224 as shown in FIG. 8. Pressure pin 188 presses against friction belt 146 to aid in opening the belt loop. Hook enhancer 160, connected to control arm 166 through link 162 pivots on a pivot pin 198 connected to the end of hook 148. Spring biased jaw 150 is lifted to its maximum extension permitting an object easy access between the support rollers and lock brace rollers.

Figure 15:
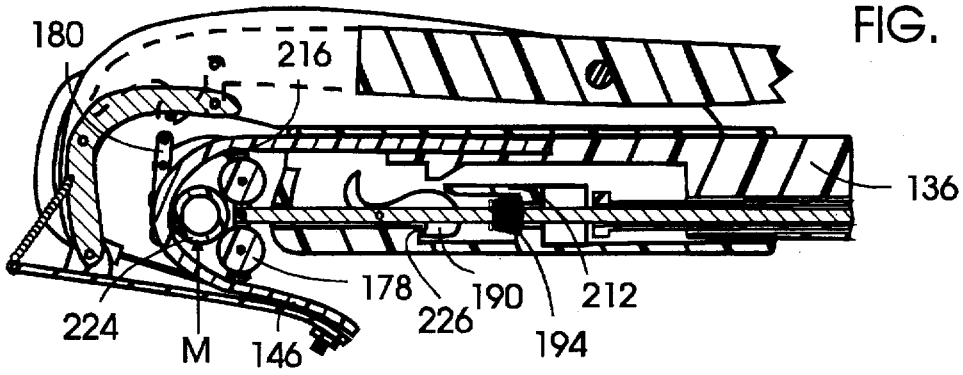
FIGS. 15–18 are cross-sectional views illustrating the sequence of operation of rotating an object being held by the tool.
Figure 18:
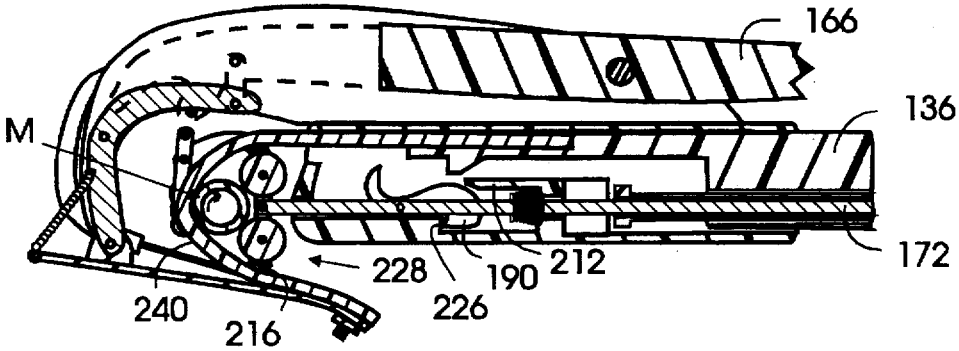

After pipe 224 has been captured between the supporting rollers, the jaw has been closed and the belt loop has contracted the pipe will be positively held by the grappling hook tool as illustrated in FIG. 15. If it is desirable to rotate pipe 224 in relationship to the tool without losing a positive holding grip on the pipe the following steps as illustrated in FIGS. 16–18. An operator pushes handle 136 into the housing to enlarge belt loop 240. As shown in FIG. 16. pipe 224 remains in a locked down position due to lock hook 190 being in locking engagement with locking ledge 226. As trip ledge 210 on handle 136 reaches lock hook tail 230 the lock hook is disengaged and supporting assembly 228 is permitted to snap forward into the expanded belt loop as illustrated in FIG. 17. As handle 136 is withdrawn from the housing to contract the belt loop as shown in FIG. 18, pipe 224 will rotate as shown by marker M which points to a spot on pipe 224 to a new position. To continue rotating pipe 224 to any desired position an operator merely repeats the sequential steps of pushing the handle in and out of the tool housing as illustrated in FIGS. 16–18.

When it is desired to release pipe 224 from the tool an operator moves control arm 166 away from handle 132 to release the pressure of lock brace rollers 182 and to open jaw 150 to its maximum extension. If necessary lever 142 is pushed to release the tension on string 145 to permit the spring tension on jaw 150 to move to its open position. The object being held such as pipe 224 may then be removed from the grappling hook tool.

Various modifications and changes in materials and design are contemplated and may obviously be resorted to without departing from the function or scope of the invention, as hereinafter defined by the appended claims. For example, the grasping belt could be provided with friction enhancing means such as teeth or notches to aid in the flexing or friction holding characteristics of the belt.

What is claimed is:

1. A grappling hook tool for grasping, manipulating, gripping, and holding comprising a housing which may be held by an operator, a hook means attached to one end of said housing, a jaw pivotally connected to the open end of said hook means, a spring means is connected to the jaw for biasing the jaw in an open position, a flexible friction belt which has one end attached to the free portion of said jaw, its opposing end attached to a slidable belt connecting means of rigid composition for pushing and pulling the belt's opposing end located ahead of and in tandem with the belt connecting means in a guide for longitudinally extending and contracting the belt in congruence with the tool's length from outside said housing hook end, where as a result of extension, said belt has formed an open belt hook in its jaw attached end, having been guided over, upward, and outward by attachment to the jaw which is pushed open by extension of the belt restrained within the confines of the hook means to, upon retracting said belt to minimum extension from the tool's housing, form a closed belt loop in the jaw attached belt's end being guided over, downward, and against said tool by attachment to the end of the jaw which is pulled toward closure against said tool's housing by the belt, the belt eminating from or retracting toward the vacinity of the junction where the housing forms a base for said hook means.

2. A method of using a grappling hook tool which enables actuating, articulating, and controlling the movement of an attached flexible belt thus causing the belt to grasp, turn, grip, and hold; comprising the steps of, opening a jaw pivotally connected to the hooked end of a hook-means extending from a housing which encloses the body of said tool, grasping an object into said open jaw, sliding a movable connecting means to contract toward said tool and around said object, a loop of the belt formed within said open jaw, pulling the jaw closed against said tool, forming a substantially closed belt loop around said object, urged by one end of the belt loop being attached to the free portion of said jaw, the body of the loop positioned above the object yet beneath and in concert with said hook means, the jaw being pulled closed against a portion of the tool's housing that also serves as a right-angled-base for said hook-means, the right-angled-base forming a ledge below the under-the-loop object while its edge faces in opposition the belt's swinging jaw-attached end, the jaw being linked-to and pulled-by a movable connecting means, and the belt-loop-end, opposite the jaw attached side, joined to a movable connecting means—all inducing the belt loop to contract around the object;

then rotating said object by continuing the constriction of the belt loop against the object toward said below-the-loop housing-ledge, actuated by sliding said belt attached connecting means, and/or then gripping the object between the closing belt loop and a firm surface element of said below-the-loop housing-ledge, allowing the object to be held;

finally, disengaging said tool by sliding in reverse the belt connecting means to enlarge said belt loop, whereby a tension spring on said jaw will open the jaw forming an opening in the belt loop to permit removing the object from said tool, the sliding having been induced by utilizing an actuation means to move a connecting means longitudinally relative to the hook means.

* * * * *